US008015638B2

(12) United States Patent
Shimada et al.

(10) Patent No.: US 8,015,638 B2
(45) Date of Patent: Sep. 13, 2011

(54) X-LINKED LIFT MECHANISM

(75) Inventors: Tatsuya Shimada, Tokyo (JP); Tooru Takada, Tokyo (JP); Jun Tomikawa, Tokyo (JP); Dan Kageyama, Tokyo (JP); Yuri Sasaki, Tokyo (JP); Katsuyoshi Nomura, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 12/742,331

(22) PCT Filed: Sep. 4, 2008

(86) PCT No.: PCT/JP2008/065981

§ 371 (c)(1),
(2), (4) Date: May 11, 2010

(87) PCT Pub. No.: WO2009/110122

PCT Pub. Date: Sep. 11, 2009

(65) Prior Publication Data

US 2010/0257671 A1 Oct. 14, 2010

(30) Foreign Application Priority Data

Mar. 4, 2008 (JP) ..... 2008-052828

(51) Int. Cl.
*A61G 7/012* (2006.01)

(52) U.S. Cl. ..... 5/611; 108/145; 108/147

(58) Field of Classification Search ..... 5/11, 611; 254/2 C, 2 R; 108/145, 147
See application file for complete search history.

(56) References Cited

U.S. PATENT DOCUMENTS

| | | | | |
|---|---|---|---|---|
| 4,567,894 | A * | 2/1986 | Bergman | 600/415 |
| 4,574,785 | A * | 3/1986 | Yamamoto | 601/5 |
| 4,577,821 | A * | 3/1986 | Edmo et al. | 108/145 |
| 4,582,310 | A * | 4/1986 | Hahn | 5/611 |
| 5,074,000 | A * | 12/1991 | Soltani et al. | 5/611 |
| 5,460,460 | A * | 10/1995 | Alexander | 14/71.3 |
| 5,694,864 | A * | 12/1997 | Langewellpott | 108/145 |
| 5,771,816 | A * | 6/1998 | Zaguroli, Jr. | 108/147 |
| 6,516,478 | B2 * | 2/2003 | Cook et al. | 5/611 |
| 2010/0257671 | A1 * | 10/2010 | Shimada et al. | 5/611 |

FOREIGN PATENT DOCUMENTS

GB 2067770 A * 7/1981

* cited by examiner

*Primary Examiner* — Michael Trettel
(74) *Attorney, Agent, or Firm* — Wenderoth, Lind & Ponack, L.L.P.

(57) ABSTRACT

An X-linked lift mechanism having first links (3) and second links (4) constituting an X-linked mechanism between a base frame (1) and a lift frame (2). A drive member (11) is pivotally rotatably installed between the other lateral side portions of the second links and is connected with boost arms (12) and a drive arm (13). Guide members (15) are provided for guiding the moving members (14) installed at the ends of the boost arms. The guide members are installed on the other lateral side portions of the first links in the length direction. Also, a linear actuator is provided so as to extend between the other lateral side of the first links and the drive arm.

6 Claims, 6 Drawing Sheets

X-LINKED LIFT MECHANISM

BACKGROUND OF THE INVENTION

1. Technical Field

The present invention relates to an X-linked lift mechanism used for a hospital bed, home nursing care bed, facility bed, general bed, consultation seat, lift table, etc.

2. Description of the Related Art

For example, as mechanisms for lifting a lift frame relative to a base frame, as used for a bed or lift table, available are many parallel-linked lift mechanisms using parallel-linked mechanisms and X-linked lift mechanisms using X-linked mechanisms. This invention relates to an X-linked lift mechanism.

In the conventional X-linked lift mechanisms proposed, for example, in Patent Document 1 and Patent Document 2, the respective ends of first links and second links on one lateral side are pivotally rotatably fixed to a base frame and a lift frame, and the moving members installed at the respective ends of the first and second links on the other lateral side are engaged with the guide members installed on the lift frame and the base frame respectively. In this configuration, the moving members installed at the tips of the action links connected with the other lateral side portions of the second links are engaged with the guide members installed on the other lateral side portions of the first links, and a lineal' actuator is provided to extend between the one lateral side portions of the first links and the moving members. Therefore, in this lift mechanism, the lift frame is raised when the lineal' actuator acts in the direction to shorten itself, i.e., in the tension direction.

Further, in another conventional example proposed in Patent Document 3, in the same configuration as in Patent Documents 1 and 2, a drive shaft is installed between the other lateral side portions of the second links, and the moving members at the tips of boost arms installed on the drive shaft are engaged with the guide members installed on the other lateral side portions of the first links. A lineal' actuator is provided to extend between the drive arms installed on the drive shaft and the one lateral side of the second links. Therefore, in this lift mechanism, the lift frame is raised when the lineal' actuator acts in the direction to elongate itself.

In the conventional X-linked lift mechanisms as described above, the lineal' actuator is provided to extend between the one lateral side and the other lateral side of the links, i.e., between both the lateral sides of the pivots at which the first links and the second links are connected with each other.

Patent Document 1: JP 8-217392 A Patent Document 2: JP 2002-320651 A Patent Document 3: JP 2005-348983 A

SUMMARY OF THE INVENTION

The abovementioned conventional X-linked lift mechanisms have the following problems.

1. A lineal actuator is provided to extend between the one lateral side and the other lateral side of the links, i.e., between both the lateral sides of the pivots at which the first links and the second links are connected with each other. Therefore, in the state where the lift frame is lowered, lift drive components such as a lineal' actuator and boost arms occupy a wide area in the space formed between the frames. Therefore, it is difficult to additionally dispose other functional mechanism components. Particularly in the case where the lift drive components are enlarged while it is intended to keep the lift frame at a position as low as possible in the state where the lift frame is fully lowered and also to keep the lift frame at a position as high as possible at the longest stroke, i.e., in the state where the lift frame is fully raised, the abovementioned difficulty is further intensified.

2. In the configuration wherein the lift frame is raised when the lineal' actuator acts in the direction to shorten itself, there is a dangerous possibility that if the lineal' actuator should be broken, the lift frame may drop.

The object of this invention is to solve these problems.

To solve the abovementioned problems, this invention proposes an X-linked lift mechanism characterized in that first links and second links are connected with each other between a base frame and a lift frame at pivots in such a manner that the first and second links can be pivotally rotated, that the respective ends of the first links and the second links on one lateral side are pivotally rotatably fixed to the base frame and the lift frame respectively, that guide members for guiding the moving members installed at the respective ends of the first and second links on the other lateral side are installed on the lift frame and the base frame respectively, that a drive member is pivotally rotatably installed between the other lateral side portions of the second links, that boost arms and drive arms are connected with the drive member, that guide members for guiding the moving members installed at the ends of the boost arms are installed on the other lateral side portions of the first links in the length direction, and that a linear actuator is provided to extend between the other lateral side of the first links and the drive arms.

Further this invention proposes an X-linked lift mechanism characterized in that first links and second links are connected with each other between a base frame and a lift frame at pivots in such a manner that the first and second links can be pivotally rotated, that the respective ends of the first links and the second links on one lateral side are pivotally rotatably fixed to the base frame and the lift frame respectively, that guide members for guiding the moving members installed at the respective ends of the first and second links on the other lateral side are installed on the lift frame and the base frame respectively, that a drive member is pivotally rotatably installed between the other lateral side portions of the second links, that boost arms and drive arms are connected with the drive member, that guide members for guiding the moving members installed at the ends of the boost arms are installed on the other lateral side portions of the first links in the length direction, that a linear actuator is provided to extend between the other lateral side of the first links and the drive arms, that an interlocking member is pivotally rotatably installed between the one lateral side portions of the first links, that boost arms and an interlocking arm are connected with the interlocking member, that the guide members for guiding the moving members installed at the ends of the boost arms are installed on the one lateral side portions of the second links, and that an interlocking link is installed between the interlocking arm installed on the interlocking member and the interlocking arm installed on the drive member.

Furthermore, this invention proposes an X-linked lift mechanism with the abovementioned configuration, wherein the guide members installed on the other lateral side portions of the first links are guide routes projected like crests.

Moreover, this invention proposes an X-linked lift mechanism with the abovementioned configuration, wherein the boost arms and the drive arms connected with the drive member are disposed like a bell crank.

In the present invention, all the lift drive components comprising the drive member provided with the boost arms and the drive arms and the lineal' actuator are installed on the other lateral side of the first links and the second links. Therefore, the lift frame is supported like a cantilever, and on the one lateral side of the first links and the second links, a space free from the lift drive components can be formed. Consequently, the degree of freedom of the layout is high, since, for example, other functional mechanism components can be disposed additionally in the space.

Further, in the case where the lift frame is supported at a low position, the boost arms projected from the interlocking member support the second links on the one lateral side. Therefore, the lift frame can be supplied like a simple supported beam, and even in the case where the load on the lift frame is large, deflection can be prevented.

Further, the lift frame is raised when the lineal actuator acts in the direction to elongate itself. Therefore, when the linear actuator is broken, buckling deformation occurs, and dropping of the lift frame can be prevented.

Further, in the case where the lift frame is supported at a low position, the angle formed between the direction of the force by the moving member of each of the boost arms connected with the drive member and the tangential direction of the wall face of the corresponding guide member can be made large, and it can be prevented that an excess load acts on the linear actuator. Particularly in the case where the guide routes are adequately projected like crests, the load acting on the linear actuator can be averaged.

Further, the linear actuator can be positioned within the region formed by the ends of the boost arms and the ends of the drive arms respectively connected with the drive member and the rotating shaft of the drive member. Therefore, the lift frame can be supported at a lower position, and when the lift frame is fully lowered, it can be supported at a position as low as possible. In addition, at the longest stroke, i.e., when the lift frame is extremely raised, it can be supported at a position as high as possible.

MEANINGS OF REFERENCE NUMERALS

Figure 1:
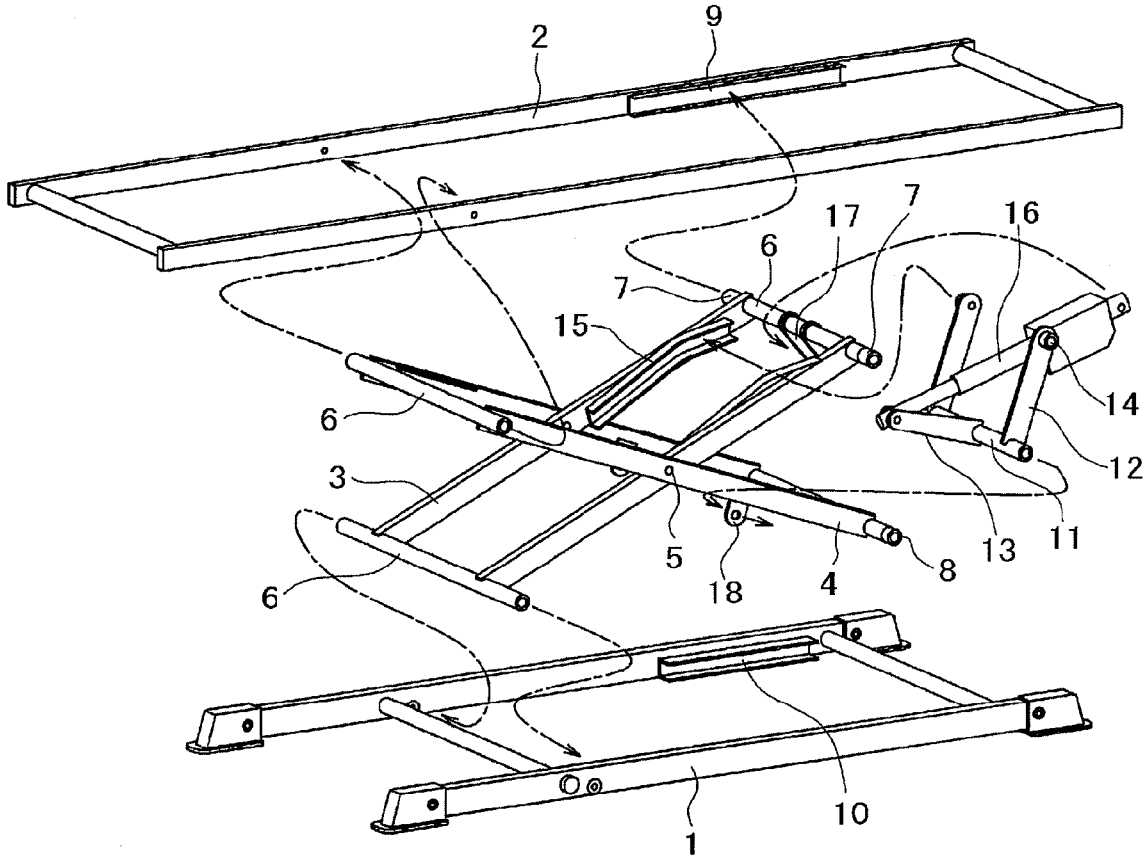
FIG. 1 is an exploded view showing the general configuration of a first embodiment of the present invention.

1 base frame
2 lift frame
3 first link
4 second link
5 pivot
6 connecting rod
7, 8, 14 roller (moving member)
9, 10, 15 guide member
11 drive member
12 boost arm
13 drive
16 linear actuator
17, 18 support arm
19 frame
20 connecting rod
21 extended portion
22 interlocking arm
23 interlocking member
24 boost arm
25 interlocking arm
26 roller (moving member)
27 guide member (strip member)
28 interlocking link

DETAILED DESCRIPTION OF THE INVENTION

Modes for carrying out the X-linked lift mechanism of this invention are explained below with reference to FIGS. 1 to 11.

First of all, FIGS. 1 to 5 show a first embodiment. Reference numeral 1 indicates a base frame, and reference numeral 2 indicates a lift frame. In the case where the article constituting the lift mechanism of this invention is a bed, the lift frame 2 is a bottom support frame for supporting the bottom of the bed, and if the article is a lift table, the lift frame 2 is a table.

First links 3 and second links 4 are connected with each other between the base frame 1 and the lift frame 2 at pivots 5 in such a manner that the first and second links can be pivotally rotated. The first links 3 are provided in parallel to each other as a pail', and the second links 4 are also provided in parallel to each other as a pair. The first links are connected with each other by connecting rods 6, and the second links are also connected with each other by other connecting rods 6.

Further, the respective ends of the first links 3 and the second links 4 on one lateral side are pivotally rotatably fixed to the base frame 1 and the lift frame 2, and the guide members 9 and 10 for guiding the rollers 7 and 8 installed as moving members at the other respective ends of the first links 3 and the second links 4 are installed on the lift frame 2 and the base frame 1 respectively. In this embodiment, horizontally placed grooved members are used as the guide members 9 and 10.

Further, a drive member 11 is installed pivotally rotatably between the other lateral side portions of the second links 4, and boost arms 12 and drive arms 13 are connected with the drive member. Guide members 15 for guiding the rollers 14 installed as moving members at the ends of the boost arms 12 are installed on the other lateral side portions of the first links 3 in the length direction, and further, a linear actuator 16 is installed so as to extend between the other lateral side portions of the first links 3 and the drive arms 13. Symbol 17 indicates a support arm installed on the connecting rod 6 of the first links 3 on the other lateral side, for pivotally rotatably supporting the base end of the linear actuator 16.

Figure 11:
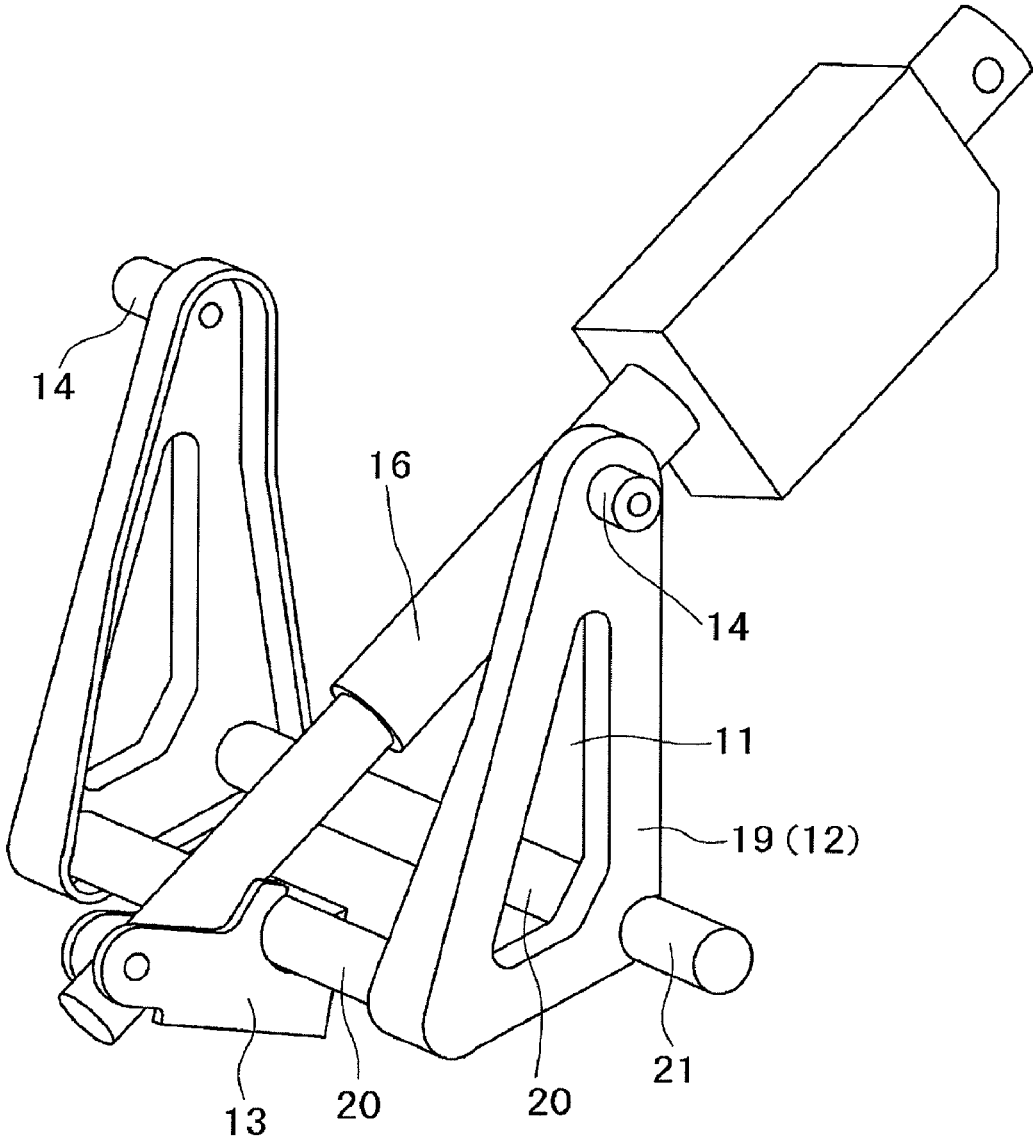
FIG. 11 is a perspective view showing a third embodiment of the drive mechanism portion.

Meanwhile, the drive member 11 shown in FIG. 1 is a rod pivotally rotatably fixed to the support arms 18 installed on the other lateral side portions of the second links 4. The drive member 11 can also be provided as frames as shown in FIG. 11. In this embodiment, as the drive member, triangular frames 19 are installed in parallel to each other and connected by connecting rods 20. The extended portions 21 of one of the connecting rods 20 are pivotally rotatably fixed to said support arms 18. In this configuration, a strong drive member 11 with high load resistance can be provided.

As described above, the guide members 15 installed on the other lateral side portions of the first links 3 for guiding the rollers 14 installed at the ends of the boost arms 12 are guide routes projected like crests, and in this configuration, as described later, the load performance of the lift frame 2 at a low position can be enhanced.

Meanwhile, as can be seen from the explanation of the above drawings, the one lateral side or the other lateral side refers to an appropriate place in the range between the respective ends of the first links 3 and the second links 4 on the one lateral side or on the other lateral side and the pivots.

Figure 2:
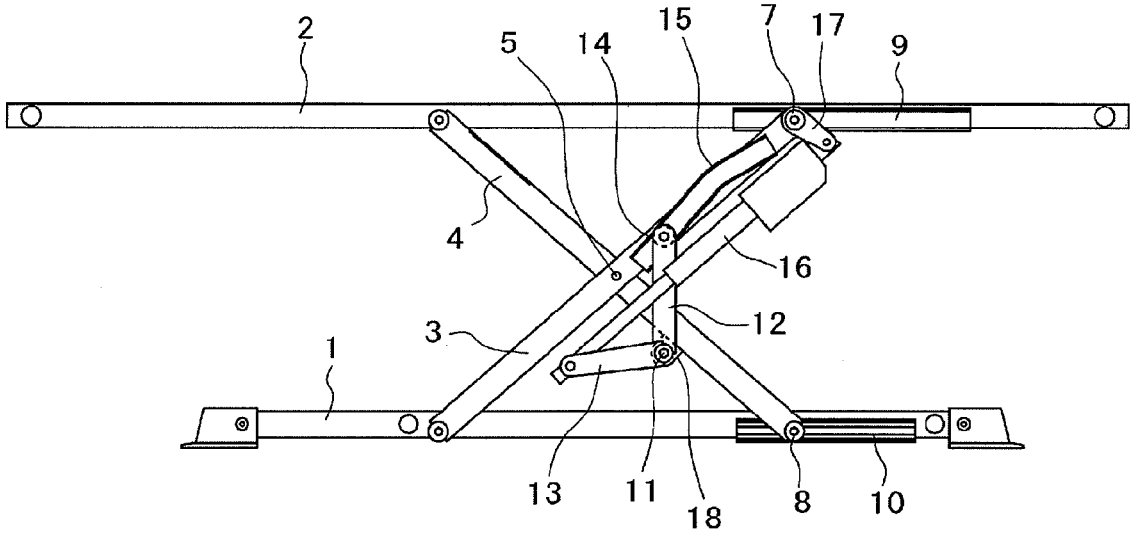
FIG. 2 is a side view showing the first embodiment of this invention.
Figure 4:
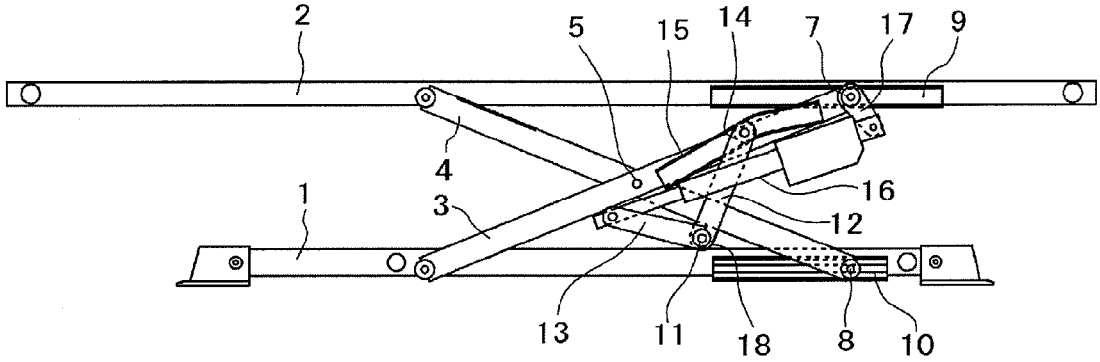
FIG. 4 is a side view showing an aspect of the invention that is different from that of FIG. 2.

In the above configuration, if the linear actuator 16 is shortened in the state where the lift frame 2 is supported at a high position as shown in FIG. 2, the boost arms 12 make the moving members 14 move gradually along the guide members 15 of the first links 3, while the second links 4 support the loads from the first links 3. Thus, the first links 3 and the second links 4 constituting the X-linked mechanism lower the lift frame 2 as shown in FIG. 4, bringing the lift frame 2 to the lowest position as shown in FIG. 5.

Figure 5:
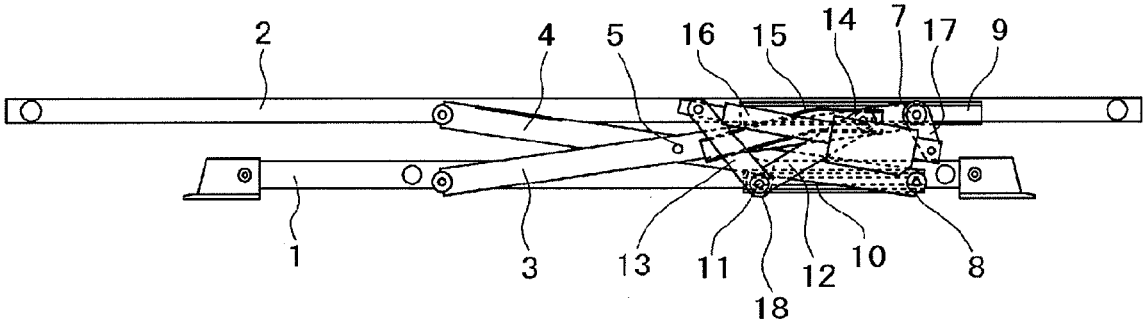
FIG. 5 is a side view showing an aspect of the invention that is different from those of the above drawings.
Figure 6:
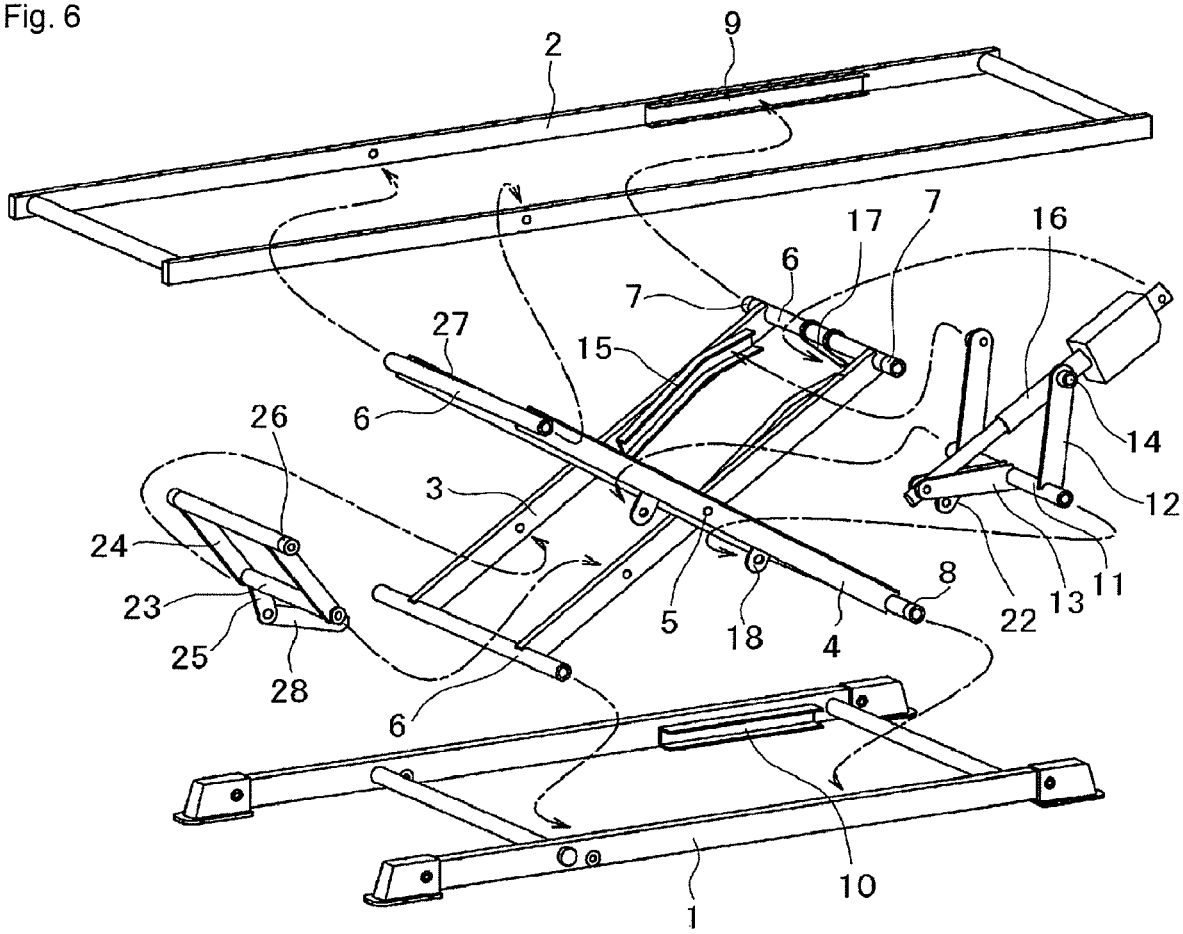
FIG. 6 is an exploded view showing the general configuration of a second embodiment of this invention.

On the other hand, if the linear actuator 16 is elongated from the lowest position of the lift frame 2 shown in FIG. 5, the lift frame 2 is raised in the action reverse to the above-mentioned action, to the position shown in FIG. 2.

As described above, in this invention, the lift frame 2 is raised while the linear actuator 16 acts in the direction to elongate itself. Therefore, when the linear actuator 16 is broken, buckling deformation occurs, and thus when it is broken, dropping of the lift frame 2 can be prevented.

Figure 3:
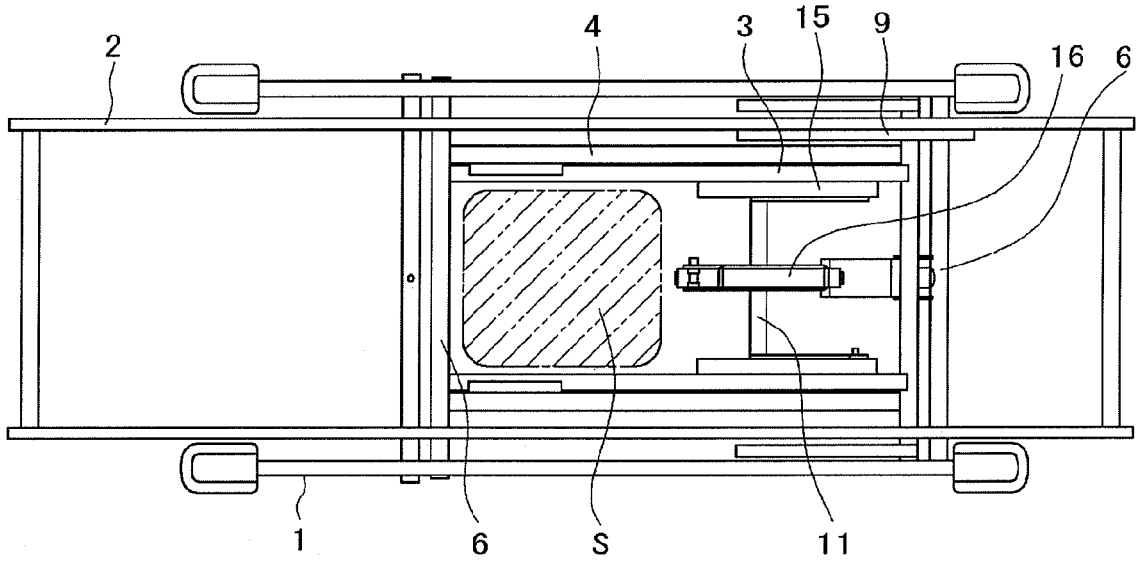
FIG. 3 is a plan view showing the first embodiment of this invention.

Further, in this invention, all the lift drive components such as the drive member 11 provided with the boost arms 12 and the drive arms 13 and the linear actuator 16 as shown in the drawings are installed on the other lateral side of the first links 3 and the second links 4. Therefore, the lift frame 2 is supported like a cantilever, and therefore, as shown in FIG. 3, a space S free from the lift drive components can be formed on the one lateral side of the first links 3 and the second links 4. Therefore, the degree of freedom of layout is high, since, for example, other functional mechanism components can be disposed in the space S.

On the other hand, in this embodiment, the guide members 15 installed on the other lateral side portions of the first links 3 are guide routes with projections like crests. Therefore, in the case where the lift frame 2 is supported at a low position, the angle formed between the direction of the force acting on each of the boost arms 12 from the lift frame 2 via the corresponding first link 3, the corresponding guide groove 15 and the corresponding moving member 14 and the tangential direction of the wall face of the corresponding guide member 15 contacted by the moving member 14 can be made large compared with the case where the guide member 15 is straight instead of being projected like a crest. Therefore, the loads acting on the boost arms 12 and on the linear actuator 16 can be averaged and excessive loads can be prevented.

Furthermore in this invention, the boost arms 12 and the drive arms 13 connected with the drive member 11 are disposed like a bell crank. Therefore, as shown in FIG. 5 the linear actuator 16 can be positioned in the region formed by the ends of the boost arms 12 and the ends of the drive arms 13 respectively connected with the drive member 11 and the rotating shaft of the drive member 11. Consequently, the lift frame 2 can be disposed at a lower position. Accordingly, in the state where the lift frame 2 is fully lowered, it can be supported at a position as low as possible, and in addition, at the longest stroke, i.e., in the state where the lift frame 2 is fully raised, it can be supported at a position as high as possible.

Next, FIGS. 6 to 10 show a second embodiment, being typical side views showing an expanded essential portion cut off from both the lateral ends of the base frame 1 and the lift frame 2 in the longitudinal direction. This second embodiment having the components of the first embodiment is characterized in that the drive member 11 is provided with an interlocking arm 22 in addition to the boost arms 12 and the drive arms 13, that an interlocking member 23 is pivotally rotatably installed between the one lateral side portions of the first links 3, that boost arms 24 and an interlocking arm 25 are connected with the interlocking member 23, that the guide members 27 for guiding the moving members (rollers) 26 installed at the ends of the boost arms 24 are installed on the one lateral side portions of the second links 4, and that an interlocking link 28 is installed between the interlocking arm 25 installed on the interlocking member 23 and the interlocking arm 22 installed on the drive member 11. In this embodiment, as shown in the drawings, the guide members 27 are provided as strip-like members projected in the horizontal direction from the top faces of the second links 4. The other configuration is the same as that of the first embodiment. Therefore, the same symbols as those of the first embodiment are used to indicate the corresponding components in the drawings to avoid redundant explanation.

Figure 7:
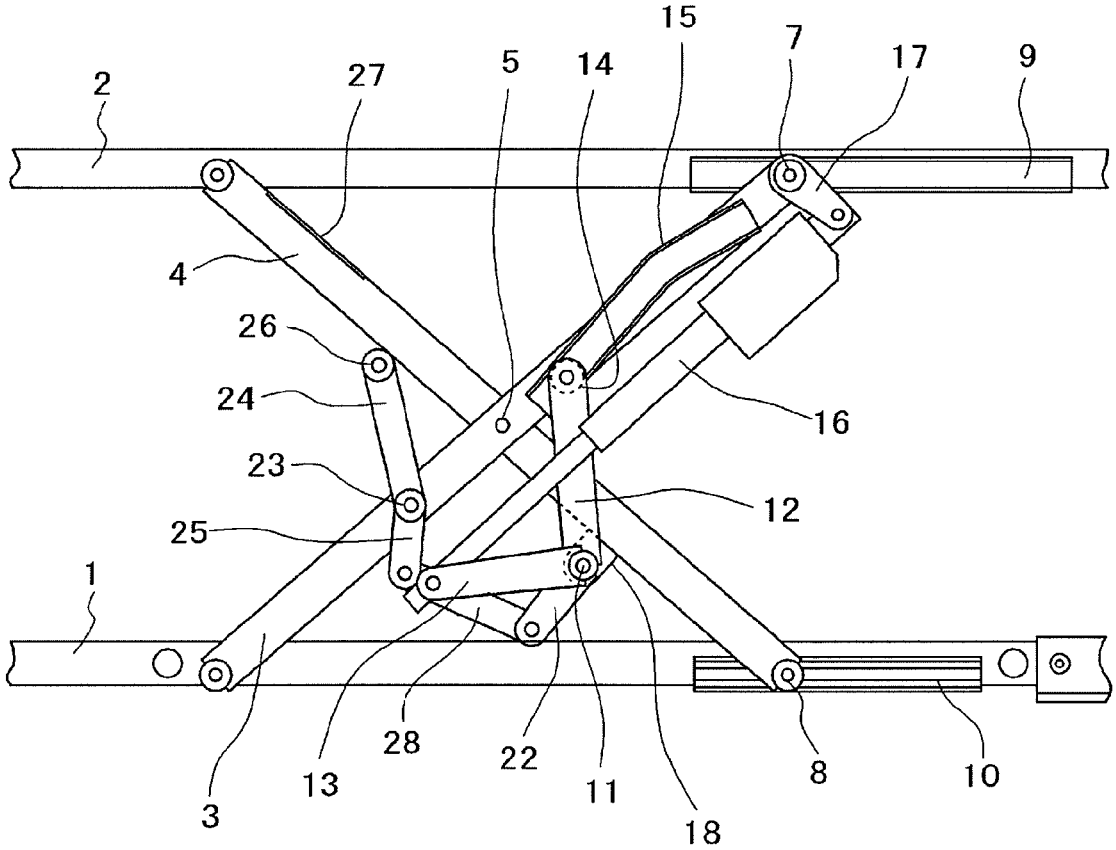
FIG. 7 is a side view showing an essential portion of the second embodiment of this invention.

In the above configuration, in the state where the lift frame 2 is supported at a high position as shown in FIG. 7, the rollers 26 at the ends of the boost arms 24 projected from the interlocking member 23 are apart from the bottom faces of the guide members 27 and do not contact the guide members 27. Therefore, in this state, the lift frame 2 is supported like a cantilever as described above. However, the angle formed between the first links 3 and the second links 4 constituting the X-linked mechanism and the base frame 1 or the lift frame 2 is large. Therefore, even if the lift frame 2 is supported like a cantilever, the lift frame 2 is not deflected.

Figure 8:
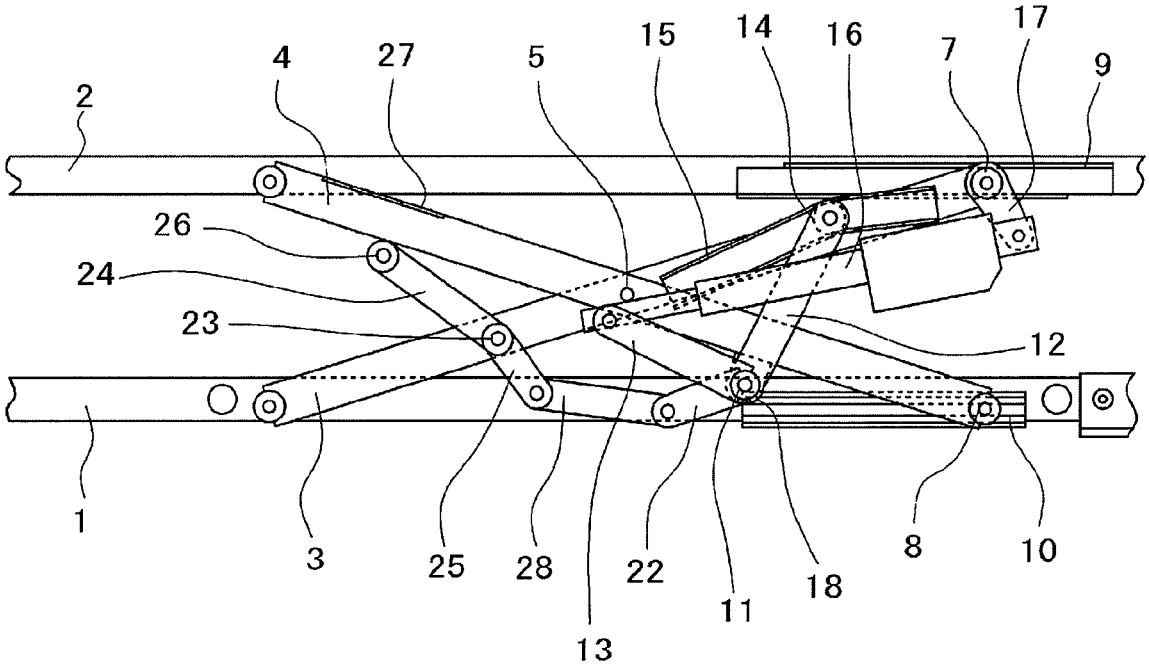
FIG. 8 is a side view showing an essential portion of an aspect of the invention that is different from that of FIG. 7.
Figure 9:
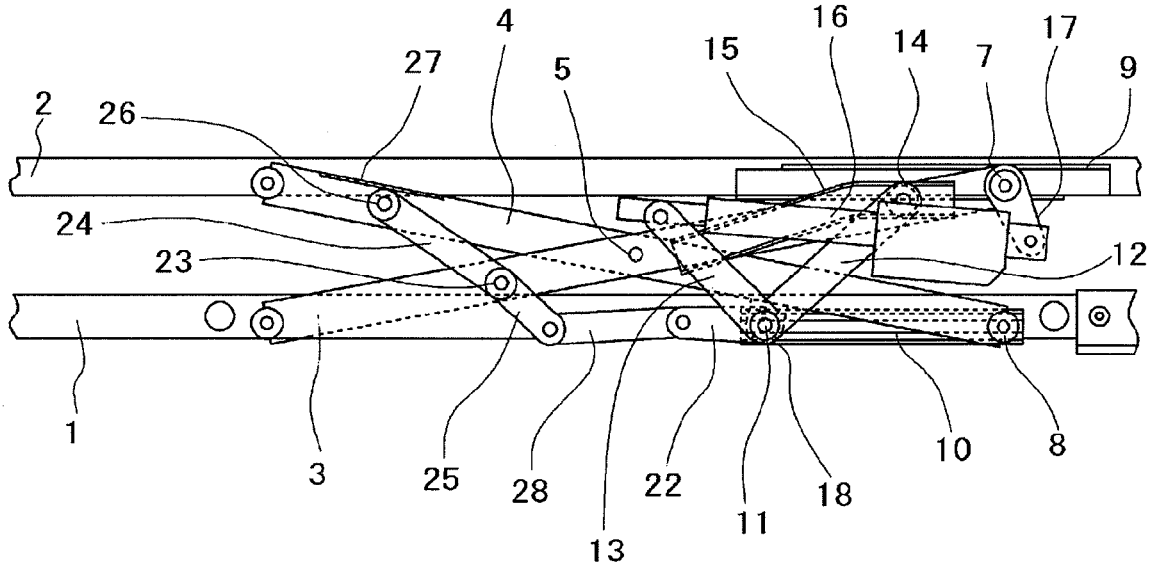
FIG. 9 is a side view showing an essential portion of an aspect of the invention that is different from those shown in the above drawings.
Figure 10:
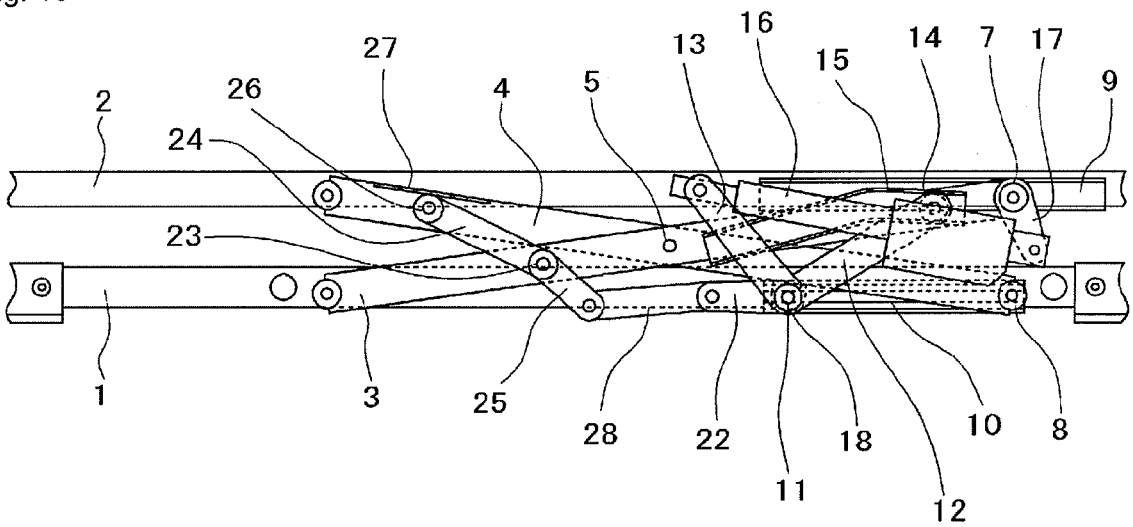
FIG. 10 is a side view showing an essential portion of an aspect of the invention that is different from those of the above drawings.

If the linear actuator 16 is shortened from the state of FIG. 7, the boost arms 12 make the moving members 14 gradually move along the guide members 15 of the first links 3 in the direction toward the other lateral side, while the loads from the first links 3 are supported by the second links 4. Thus, the first links 3 and the second links 4 constituting the X-linked mechanism lower the lift frame 2 as shown in FIG. 8. If the lift frame 2 is lowered to a certain height, the rollers 26 at the ends of the boost arms 24 projected from the interlocking member 23 contact the bottom faces of the guide rollers 27 as shown in FIG. 9, and until the lowest position of FIG. 10 is reached, the boost arms 24 can support the loads from the guide members 27.

In this embodiment, in the case where the lift frame 2 is supported at a low position, the boost arms 24 projected from the interlocking member 23 support the one lateral side portions of the second links 4 via the moving members 26 and the guide members 27. Therefore, the lift frame 2 is supported like a simple supported beam, and even if the load on the lift frame 2 is large, deflection can be prevented.

In this case, on the one lateral side of the first links 3 and the second links 4, the interlocking member 23, the boost arms 24, the interlocking arm 25 and the interlocking link 28 are disposed. However, since the linear actuator is not located there, the corresponding space can be formed, and the degree of freedom of layout is high since, for example, other functional mechanism components can be disposed there.

As can be seen from the above explanation, the X-linked lift mechanism of this invention has various advantages as described above, and can be used for medical and household beds and also for lift tables, etc., being industrially highly applicable.

The invention claimed is:

1. An X-linked lift mechanism comprising:

a base frame;

a lift frame;

first links and second links connected with each other between the base frame and the lift frame at pivots in such a manner that the first and second links can be pivotally rotated, wherein first ends of the first links are pivotally rotatably fixed to the base frame, and first ends of the second links are pivotally rotatably fixed to the lift frame;

moving members installed at second ends of the first and second links, respectively;

guide members for guiding the moving members installed at the second ends of the first and second links, wherein the guide members are installed on the lift frame and the base frame, respectively;

a drive member pivotally rotatably installed between the second links, the drive member being provided with boost arms and drive arms;

moving members installed at ends of the boost arms;

guide members for guiding the moving members installed at the ends of the boost arms, the guide members being installed on opposing side portions of the first links in the length direction; and a linear actuator extending the first links and the drive arms.

2. An X-linked lift mechanism comprising:

a base frame;

a lift frame;

first links and second links connected with each other between the base frame and the lift frame at pivots in such a manner that the first and second links can be pivotally rotated, wherein first ends of the first links are pivotally rotatably fixed to the base frame, and first ends of the second links are pivotally rotatably fixed to the lift frame;

first moving members installed at second ends of the first links, respectively;

second moving members installed at second ends of the second links, respectively;

guide members for guiding the first and second moving members installed at the respective second ends of the first and second links, the guide members being installed on the lift frame and the base frame, respectively;

a drive member pivotally rotatably installed between the second links, the drive member being provided with an interlocking arm, boost arms and drive arms;

third moving members installed at ends of the boost arms;

guide members, for guiding the third moving members, installed on opposing side portions of the first links in a length direction;

a linear actuator provided so as to extend between the first links and the drive arms;

an interlocking member pivotally rotatably installed between side portions of the first links;

boost arms and an interlocking arm connected with the interlocking member;

fourth moving members installed at ends of the boost arms;

guide members for guiding the fourth moving members that are installed at the ends of the boost arms, the guide members being installed on opposing side portions the second links; and an interlocking link installed between the interlocking arm installed on the interlocking member and the interlocking arm installed on the drive member.

3. An X-linked lift mechanism, according to claim 1, wherein the guide members installed on the opposing side portions of the first links are guide routes projected like crests.

4. An X-linked lift mechanism, according to claim 1, wherein the boost arms and the drive arms connected with the drive member are disposed like a bell crank.

5. An X-linked lift mechanism, according to claim 2, wherein the guide members installed on the opposing side portions of the first links are guide routes projected like crests.

6. An X-linked lift mechanism, according to claim 2, wherein the boost arms and the drive arms connected with the drive member are disposed like a bell crank.

* * * * *